United States Patent [19]

Amaya

[11] Patent Number: 4,708,741

[45] Date of Patent: Nov. 24, 1987

[54] RAPID SINTERING FEEDSTOCK FOR INJECTION MOLDING OF STAINLESS STEEL PARTS

[75] Inventor: German Amaya, Longwood, Fla.

[73] Assignee: Brunswick Corporation, Skokie, Ill.

[21] Appl. No.: 873,957

[22] Filed: Jun. 13, 1986

[51] Int. Cl.[4] ..... B22F 3/00

[52] U.S. Cl. ..... 75/251; 75/255

[58] Field of Search ..... 420/52, 57; 75/251, 75/252, 255, 950; 148/327, 902

[56] References Cited

U.S. PATENT DOCUMENTS 3,620,690 11/1971 Bergstrom ..... 75/950

FOREIGN PATENT DOCUMENTS 134246 2/1979 German Democratic Rep. ..... 148/327

T21224 9/1979 Japan ..... 148/327

OTHER PUBLICATIONS

Peckner et al., Handbook of Stainless Steels, pp. 10--9-10-14, published by McGraw Hill Book Company.

*Primary Examiner*—Christopher W. Brody

*Attorney, Agent, or Firm*—Art Greif

[57] ABSTRACT

A feedstock, for the production of stainless steel injection molded parts, capable of producing high theoretical density using lower than conventional sintering temperatures. In the production of powder metal parts, densities approaching theoretical density are normally achieved by the use of high compaction pressures, high temperature sintering, or a combination of both. By employing a higher chromium content and a lower nickel content than conventional 316L stainless steel, a duplex structure of ferrite and austenite will be produced with superior sintering capability—resulting in higher densification and better mechanical properties at lower sintering temperatures.

4 Claims, 1 Drawing Figure

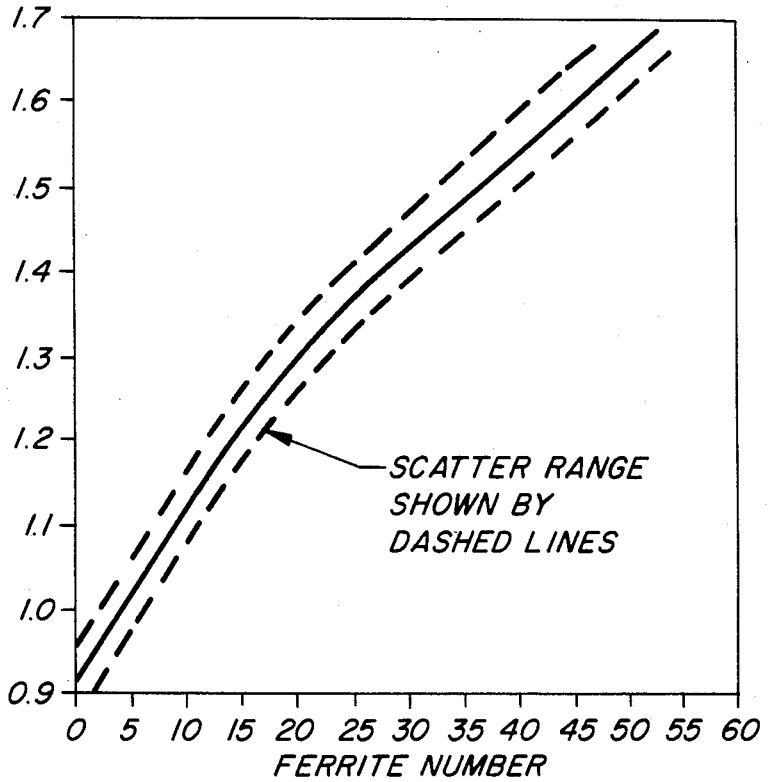
(PRIOR ART)

RAPID SINTERING FEEDSTOCK FOR INJECTION MOLDING OF STAINLESS STEEL PARTS

TECHNICAL FIELD

This invention relates to the injection molding of metal parts, and is more particularly related to an injection molding feedstock which utilizes a modified type 300 stainless steel composition capable of forming a duplex ferrite-austenite alloy with enhanced sinterability.

BACKGROUND ART

The production of metal parts utilizing powdered materials comprises a variety of techniques. One such technique, injection molding, offers a number of advantages over what may be termed "conventional" powder metallurgy methods. These advantages include comparatively low capital investment and operating costs, coupled with the ability to produce intricate metal shapes approaching the properties and densities of wrought metal, to "near-net shape", i.e., often obviating the need to perform secondary machining operations. The process is basically an offshoot of conventional plastic forming techniques and comprises:

(i) intimately mixing fine metal powders with an organic binder utilizing about 75–95 weight percent (or about 30–75 volume percent) metal powder—the balance, organic binder materials;

(ii) the so-mixed plasticized batch is then injection molded in conventional plastic molding equipment at relatively low pressures and temperatures into a mold generally designed to be about 10–20% larger in each dimension than the final desired part;

(iii) the organic binder is thereafter removed by solvent extraction or thermal degradation so as to not destroy the integrity of the shape; and (iv) the resulting metal skeleton is thereafter sintered to final density, desirably approaching theoretical density.

In an attempt to provide a sintered part with superior mechanical properties and densities, the art has resorted to the use of sintering temperatures at the high end of the normal range, or longer hold times, or a combination of both. Since sintering is a diffusion-controlled phenomena, there is obviously a time/temperature relationship in achieving essentially equivalent sintered properties. Longer hold times are less desirable, because of increased cost resulting from extra energy usage and decreased productivity. While hold time can be decreased by resorting to higher temperatures, this expedient also offers a number of disadvantages in that it, too, is more costly—due to both higher energy costs and the need for more expensive furnaces.

SUMMARY OF THE INVENTION

One of the most common materials utilized in the production of injection molded parts is conventional 316L stainless steel alloy. It has now been found that by modifying the basic constituents of the conventional 18Cr-8Ni wrought stainless steel, as well as the conventional 19Cr-9Ni CF grade cast alloy stainless steels, that a duplex ferrite-austenite alloy can be produced with superior sinterability. That is, the steel skeleton will achieve greater densification and superior mechanical properties at either (i) lower temperatures (for an equivalent amount of time), or (ii) faster times (at an equivalent temperature). This is accomplished by shifting the composition ranges of conventional 316L to higher chromium and lower nickel contents so as to produce a duplex ferrite-austenite steel having a greater amount of ferrite than that of the conventional 316L or even that of the CF grade duplex steels.

BRIEF DESCRIPTION OF THE DRAWING

The FIGURE shows a constitution diagram for estimation of ferrite content in stainless steels (as developed by Schoefer).

It is well known that, by balancing the amounts of ferrite-forming vs. austenite-forming elements, it is possible to increase the amount of ferrite present in the austenite matrix. The principal ferrite promoters are chromium, silicon, and molybdenum; while the principal austenite stabilizers are nickel, carbon, nitrogen, and manganese. Schoefer prepared a diagram for estimating the ferrite content in stainless steel over a composition range of 16–26% chromium, 6–14% nickel, up to 4% molybdenum, up to 1% columbium, up to 0.2% carbon, up to 0.19% nitrogen, up to 2% manganese, and up to 2% silicon. Use of this diagram, shown in FIG. 1, requires that all ferrite-stabilizing elements be converted into "chromium equivalents" and that all austenite-stabilizing elements be converted into "nickel equivalents" by use of the following formulas.

$$Cr_e = (\%Cr) + 1.5(\%Si) + (\%Mo) + (\%Cb) - 4.99 \quad (1)$$

$$Ni_e = (\%Ni) + 30(\%C) + 0.5(\%Mn) + 26(\%N - 0.02) + 2.77 \quad (2)$$

The ratio, $Cr_e/Ni_e$, of the chromium equivalents to nickel equivalents obtained by the above formulas, permits the prediction of the approximate amount of ferrite in the resulting alloy. While the "ferrite number" shown in the Schoefer diagram does not provide an exact correspondence with the actual volume percent of ferrite present, there exists a close relationship. The enhanced sinterability of the instant invention will be achieved for modified 316L alloys having a "composition ratio" of 1.4–1.65, and more preferably from 1.45–1.60.

MODES FOR CARRYING OUT THE INVENTION

Metal powders used for metal injection molding should have a low free surface energy for mixing and a high free surface energy for sintering. These objectives will generally be achieved if the powders have a near spherical shape and a small average particle size, generally below 40 microns. The desired concentration of the sintered particles can be achieved by providing: (i) fully pre-alloyed powders having that composition; (ii) elemental powders in proportions which will provide the desired cumulative concentration; or (iii) a combination of pre-alloyed and elemental powders. The use of at least a significant portion of elemental powders is desirable, since it more readily allows the use of powders with varying size ranges and distributions, permitting greater filling-in of the spaces between particles—thereby reducing the amount of binder requirements and improving the moldability of the feedstock. A preferred mix of metal powders useful in the instant invention will therefore comprise: elemental carbonyl iron, carbonyl nickel and molybdenum powders together with ferrochrome powders—in which substantially all the powders are finer than 40 microns (preferably more than 90% will fall within the range of 2–30 microns) and have a mean particle size within the range of 5–15 microns.

The metal particles are thereafter blended with one of the many organic binders known to the art and heated to a temperature on the order of 300° F. to reduce the viscosity of the feedstock—such that it is in the fluid state capable of being injected into a mold under relatively low pressure, e.g., 2000–6000 psi cavity pressure. The use of just enough pressure to permit the feedstock to fill the mold cavity should be contrasted with conventional powder metallurgy techniques which depend upon significantly higher pressures to obtain a fabricated part on the order of 90% theoretical density. The green part from the injection molder is thereafter debinderized and sintered at temperatures, normally ranging from 2000°–2500° F.

Three feedstocks were prepared: one in which the cumulative concentration (i.e., the final sintered alloy composition) was provided by elemental powders, to yield a conventional 316L sintered alloy composition; the second in which substantially the same cumulative concentration was provided by pre-alloyed powders; and the third in which the cumulative concentration was also provided by elemental powders, to provide a composition in accord with the instant invention. The three feedstocks were prepared using the same processing techniques, i.e., the same binder formulation, the same metal powder loading, and the same debinderizing and sintering. Sintering was achieved utilizing an average heat up rate of 10° F. per minute and a hold time of two hours at a maximum temperature of 2290° F. The resulting mechanical properties of the three different feedstock compositions (Table I) are provided in Table II below.

TABLE I

| | Metal Powder Compositions | | | | | | | | | |
|---|---|---|---|---|---|---|---|---|---|---|
| | C | Si | Mn | P | S | Cr | Ni | Mo | N | Fe |
| Elemental | .022 | .48 | .64 | .010 | .008 | 16.5 | 10.2 | 2.09 | .045 | bal |
| Pre-alloyed | .03 | .50 | .58 | .010 | .008 | 16.7 | 12.2 | 3.2 | <.01 | bal |
| Duplex | .02 | .55 | .26 | <.01 | .01 | 20.5 | 10.26 | 3.19 | <.01 | bal |

TABLE II

| | Mechanical Properties | | | | |
|---|---|---|---|---|---|
| | UTS (KSI) | Yield (KSI) | Elongation % | Density % Theoretical | Hardness Rb |
| Elemental | 65 | 25 | 44 | 93 | 45 |
| Pre-alloyed | 72 | 25 | 50 | 94 | 60 |
| Duplex | 79 | 39 | 45 | 98 | 84 |

It is seen from the above, while the pre-alloyed powders for the same composition will yield superior mechanical properties, that the properties, even for such pre-alloyed powders, cannot match the improvement provided by the inventive composition—although the latter also employed elemental powders.

The enhanced sintering alloys of the invention desirably will be selected from powders which will provide the cumulative concentrations within the ranges set forth in Table III below. Additionally, the components will be balanced such that the contents of ferrite- and austenite-forming elements will provide a "composition ratio" (as determined by Equations 1 and 2) of 1.4–1.65.

TABLE III

| | |
|---|---|
| Nitrogen | <0.05% |
| Carbon | <0.03% |
| Manganese | <0.5% |
| Sulphur | <0.03% |
| Phosphorus | <0.05% |
| Silicon | <0.5% |
| Chromium | 18–22% (preferably <20%) |
| Nickel | 6–10.5% (preferably <8%) |
| Molybdenum | 1–3% (preferably <2%) |
| Iron | balance |

Carbon is desirably kept below 0.03%, primarily to avoid chromium carbide precipitation at the grain boundaries, but also to make the requisite "composition ratio" more readily obtainable, since carbon is a strong austenite promoter. The maximum manganese, sulphur, and phorphorus ranges are established primarily to increase the pitting corrosion resistance of the alloy. The preferred ranges of nickel and molybdenum are desirable to decrease the tendency for the formation of the brittle sigma phase.

I claim:

1. A feedstock for the injection molding of type 300 stainless steel parts, consisting essentially of 75–95 weight percent finely divided metal powders; the balance, sacrificial binder materials, characterized by metal powders substantially all of which are finer than 40 microns and having a mean particle size finer than 15 microns, the cumulative concentrations of said powders consisting essentially of 18 to less than 20% Cr, 6 to less than 8% Ni, 1 to less than 2% Mo, with the balance essentially Fe and minor amounts of elements such as nitrogen, carbon, manganese, sulphur, phosphorus, and silicon, normally present in such type 300 steels, and wherein the ratio of chromium equivalents to nickel equivalents is within the range 1.4–1.65.

2. The feedstock of claim 1, in which N does not exceed 0.05%, C does not exceed 0.03%, Mn does not exceed 0.5%, S does not exceed 0.03%, P does not exceed 0.05%, and Si does not exceed 0.5%.

3. The feedstock of claim 2, in which a major portion of the elements Cr, Ni, and Mo are provided by unalloyed powders of such elements.

4. The feedstock of claim 3, in which more than 90% of said powders are within the range 2 to 30 microns.

* * * * *